United States Patent [19]

McBeth

[11] Patent Number: 4,898,077

[45] Date of Patent: Feb. 6, 1990

[54] SELF-BLEEDING HYDRAULIC PUMPING APPARATUS

[75] Inventor: James B. McBeth, N. Vancouver, Canada

[73] Assignee: Teleflex Incorporated, Limerick, Pa.

[21] Appl. No.: 241,079

[22] Filed: Sep. 6, 1988

[51] Int. Cl.[4] ..... F01B 3/00; F01B 13/04

[52] U.S. Cl. ..... 91/505; 91/499; 92/12.2; 92/70; 92/71; 92/107

[58] Field of Search ..... 91/499, 500, 501, 502, 91/503, 504, 505, 506, 507; 92/12.2, 70, 71, 51, 65, 107, 162 R, 174; 417/430

[56] References Cited

U.S. PATENT DOCUMENTS

| | | | |
|---|---|---|---|
| 1,970,133 | 8/1934 | Ferris et al. | 91/503 |
| 2,467,916 | 4/1949 | Shepard | 91/506 |
| 2,480,069 | 8/1949 | Wright | 91/499 |
| 2,625,109 | 1/1953 | Coberly | 91/499 |
| 3,319,576 | 5/1967 | Orshansky, Jr. | 91/499 |
| 3,375,756 | 4/1968 | Bienaime | 91/506 |
| 3,450,058 | 6/1969 | Stein | 91/507 |
| 3,667,867 | 6/1972 | Boydell et al. | 91/506 |
| 3,830,593 | 8/1974 | Chanal | 91/506 |
| 4,188,859 | 2/1980 | Van Wagenen et al. | 91/499 |

FOREIGN PATENT DOCUMENTS

| | | | |
|---|---|---|---|
| 945034 | 4/1949 | France | 91/506 |
| 1033355 | 6/1966 | United Kingdom | 91/499 |

*Primary Examiner*—Randall L. Green
*Assistant Examiner*—Thomas Denion
*Attorney, Agent, or Firm*—Reising, Ethington, Barnard, Perry & Milton

[57] ABSTRACT

A swash plate type hydraulic pumping assembly (10) including a plurality of pistons (28) axially reciprocated in individual chambers (22) of a rotor (20). Each piston (28) includes a hollowed central cavity (30) supporting a compression spring (54) which urges the piston (28) out of the chamber (22) and toward a camming surface (64) of the swash plate (60). A tube (42) is disposed in the chamber (22) adjacent a hydraulic fluid exhaust port (24) and forms the only flow route for fluid entering or exiting the chamber (22). A top surface (34) in the cavity (30) of the piston (28) is spaced from the exhaust port (24) and collects gas inclusions trapped in the fluid during operation. When the piston (28) is moved in the chamber (22) to a fully compressed position, the top spaced surface (34) is very close to the tube (42) allowing the trapped gas inclusions to be swept away from the top spaced surface (34) and out of the pump assembly (10).

28 Claims, 4 Drawing Sheets

SELF-BLEEDING HYDRAULIC PUMPING APPARATUS

TECHNICAL FIELD

The subject invention relates to a hydraulic pumping assembly, and more particularly to a self-bleeding swash plate type pump assembly for actuating a steering system in a marine craft.

BACKGROUND ART

Hydraulic pumping assemblies of the type including a swash plate and a plurality of axially orientated pistons are well suited for use in the steering system of a marine craft. More particularly, the movements of an outboard motor or rudder of the marine craft are often controlled by a hydraulic cylinder reacting to the pressure of fluid in a hydraulic steering system. Typically, a steering wheel is attached to an input shaft of the hydraulic pumping assembly, which steering wheel is turned by an operator to control the course of the craft.

It is common practice to provide a central hollowed cavity in pistons for a number of different reasons. One reason for providing a cavity in the pistons is to receive a return compression spring for urging the pistons out of their associated chamber and against the swash plate camming surface. The springs will usually nest, or telescope, into the piston cavity with the reciprocating movement of the piston. A typical pump mounting orientation in the marine craft supports the pistons in an inverted position wherein they are urged by the return springs in a generally upward direction out of their associated chambers. This mounting orientation is quite practical and facilitates connection of the conduit lines behind the dashboard of the marine craft.

A persistent problem results from orientating the pump as described above in that gas inclusions trapped in the hydraulic fluid, upon entering the cylinder chamber, move toward the highest elevational position. This highest elevational position is frequently adjacent a top surface in the cavity of the piston. Therefore, during operation of the prior art hydraulic swashplate type pumping assemblies, air inclusions tend to congregate adjacent this top spaced surface in the cavity of the piston and resist discharge with the fluid when the piston is moved into a compressed position. Failure to remove these trapped gas inclusions from the cylinder chamber result in lost pumping efficiency due to the additional compression required to compress the air prior to generating enough pressure in the hydraulic fluid to do work. Additionally, in a closed circuit conduit system, fluid is not moved through the conduit system while the pistons compress the gas inclusions.

The U.S. Pat. Nos. 3,935,796 to Wood, issued Feb. 3, 1976, and Reissue 24,048 to Wright, issued Aug. 2, 1955, disclose examples of the prior art described above wherein the pistons of a swash plate pump include a central hollow cavity for receiving a return compression spring. The U.S. Pat. No. 3,280,395 to Budzich, issued Sept. 28, 1965, discloses a swash plate hydraulic pump assembly including axial pistons having central hollow cavities. The Budzich piston cavities are provided for reasons other than receiving a return spring therein. Accordingly, when any one of these prior art hydraulic pumping assemblies are operated in such an orientation that the pistons are urged in an upward direction out of their associated chambers, gas inclusions trapped in the hydraulic fluid entering the chamber will migrate toward and remain adjacent the uppermost spaced surface, and resist expulsion with the discharging fluid.

SUMMARY OF THE INVENTION AND ADVANTAGES

A piston pump assembly of the type for moving a liquid through a conduit system is provided and includes a housing. Cylinder means are disposed in the housing for receiving a volume of the liquid from and expelling the same volume of liquid back into the conduit system. The cylinder means includes at least one liquid exhaust port. Piston means are slidably disposed in the cylinder means toward and away from a compressed position adjacent the exhaust port for urging liquid through the exhaust port. The piston means includes a surface in continuous contact with the liquid and spaced remotely of the exhaust port when the piston means is adjacent the compressed position. The assembly is characterized by including bleed means disposed in the cylinder means having a first opening in communication with the exhaust port and a second opening closely spaced from the spaced surface when the piston means is adjacent the compressed position for expelling the liquid from the cylinder means as the piston means moves toward the compressed position to force gas inclusions trapped in the cylinder means adjacent the spaced surface into the bleed means and out of the cylinder means.

The bleed means also controls the movement of the liquid exiting the cylinder means to flow in a direction across the spaced surface to sweep gas inclusions trapped adjacent the spaced surface with the exhausting liquid movement and out of the exhaust port.

The bleed means of the subject assembly effectively and efficiently removes gas inclusions trapped in the cylinder means so that fluid pumping is improved, thus overcoming the deficiencies in the prior art.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENT OF FIGS. 1-3

Figure 1:
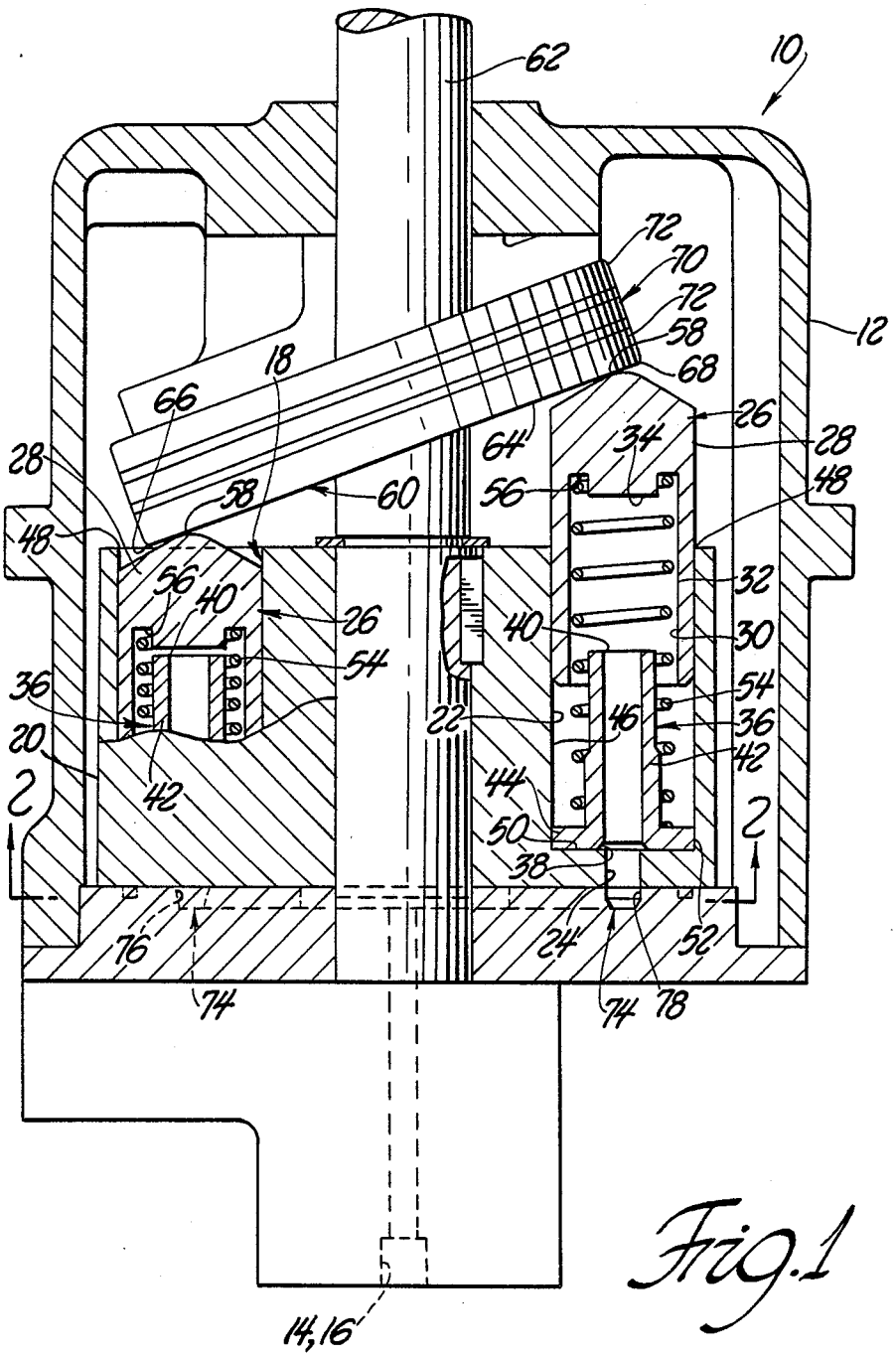
FIG. 1 is a side view of the subject invention shown in cross section.

A hydraulic pump assembly of the swash plate type according to the subject invention is generally shown at 10 in FIG. 1. The pump assembly 10 is shown including a housing 12 for encasing the assembly 10 which contains the hydraulic fluid and protects the internal parts. As best shown in connection with FIG. 2, a first tap 14 and a second tap 16 are provided in the housing 12 for connecting fluid-carrying conduit lines of a conduit system to the pump assembly 10. Normally, the conduit system comprises a closed circuit having a movable hydraulic cylinder therein, remote from the pump assembly 10, for actuating the outboard motor or rudder of a marine craft. Accordingly, the pump assembly 10 is adapted for moving a hydraulic liquid through the conduit system in response to the inputs from an operator of the marine craft. However, it is to be appreciated that the subject pump assembly 10 may have uses in many environments other than the marine craft steering systems referred to as exemplary herein.

Cylinder means, generally indicated at 18 in FIG. 1, is provided for receiving a volume of the hydraulic liquid from the conduit system and expelling the same volume of liquid back into the conduit system via the first 14 and second 16 taps. A rotor means 20 encases the cylinder means 18 and is supported in the housing 12 for rotation about an axis thereof. As shown in hidden lines in FIG. 2, the cylinder means 18 includes seven piston chambers 22 disposed circumferentially in the rotor means 20 which extend axially, or parallel, to the rotor means axis. Each chamber 22 has a central longitudinal axis parallel to the rotor means axis. Seven liquid exhaust ports 24 are disposed through the rotor means 20 and are each associated with a chamber 22 for directing the flow of hydraulic fluid into and out of the chambers 22. Thus, the exhaust ports 24 intermittently communicate with the first 14 and second 16 taps as the rotor means 20 is rotated.

Piston means, generally indicated at 26 in FIG. 1, is slidably disposed in the cylinder means 18 toward and away from a compressed position adjacent the exhaust port 24 for urging the hydraulic fluid through the exhaust port 24. The piston means 26 includes seven individual pistons 28, one piston 28 being associated with each chamber 22. The pistons 28 are slideably received in their associated chambers 22 for reciprocating movement in a direction along the longitudinal axis of the chamber 22.

Each of the pistons 28 are cylindrical and have a generally U-shaped cross section, when taken through its axis. A central cylindrical cavity 30 is provided in each piston 28, thus defining the U-shaped cross section. Each piston 28, therefore, has a hollowed center presenting an inverted cup-shaped appearance. The cavity 30 is presented toward the exhaust port 24 so that it is in continuous contact with the hydraulic liquid. The cavity 30 is bounded by a tubular side 32 and a circular top 34. The top 34 forms a top spaced surface 34 which is in continuous contact with the hydraulic liquid and spaced remotely from the exhaust port 24 when the piston 28 is adjacent the compressed position, as shown in FIG. 1. In other words, the top 34 is always spaced from the port 24, no matter what position the piston 28 is in during its stroke.

Figure 3:
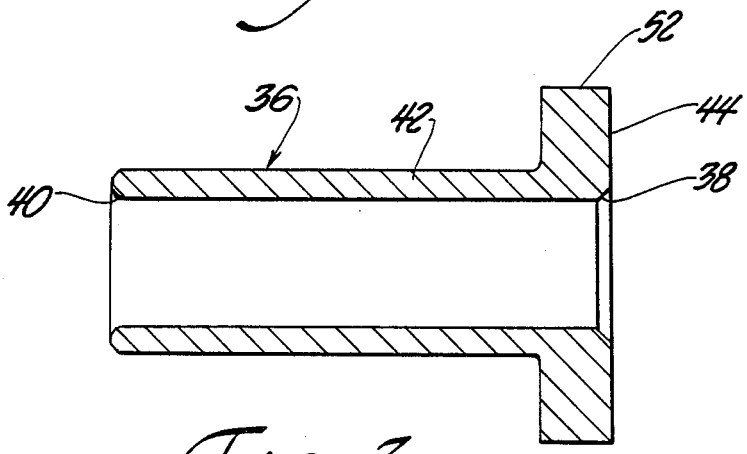
FIG. 3 is an enlarged cross-sectional view of the bleed means of FIGS. 1 and 2.

When the assembly 10 is mounted in a marine craft in an orientation such that the top spaced surface 34 of the cavity 30 is maintained at a higher elevation than the exhaust port 24, gas inclusions in the hydraulic liquid entering the piston chamber 22 migrate toward and collect adjacent the top spaced surface 34. Because the top surface 34 is spaced from the exhaust port 24 at all times, these gas inclusions would remain adjacent the top surface 34 throughout the intake and discharge cycle of the piston 28, and thereby decrease the pumping efficiency of the assembly 10. To this end, the subject assembly 10 is characterized by including bleed means, generally indicated at 36, which is disposed in each of the chambers 22 of the cylinder means 18. The bleed means 36 has a first opening 38 in communication with each exhaust port 24 and a second opening 40 closely spaced from each top spaced surface 34 of the cavities 30 when the pistons 28 are adjacent their compressed position. More particularly, as shown in FIGS. 1 and 3, the bleed means 36 includes a cylindrical tube 42 extending straight and axially between the first 38 and second 40 openings within each chamber 22. The axis of the tube 42 is coincidental with the longitudinal axes of both the chamber 22 and the cavity 30 of the associated piston 28. An annular flange 44 extends radially outwardly from the tube 42 adjacent the first opening 38 for supporting the bleed means 36 in the chambers 22.

As shown in FIG. 1, each chamber 22 is bounded, or formed, by a cylindrical inner wall 46 disposed in the rotor means 20. The inner wall 46 of the chamber 22 extends from a top opening 48 to a lower and perpendicular head surface 50. The flange 44 of the bleed means 36 has an outer annular edge 52 which is in continuous peripheral sealing engagement with the chamber wall 46 adjacent the exhaust port 24. Therefore, as each piston 28 moves toward its compressed position to expel the entrapped liquid from its associated chamber 22, the gas inclusions trapped adjacent the top spaced surface 34 are forced into the bleed means as the top spaced surface 34 moves close to the second opening 40. Because the outer edge 52 of the flange 54 engages and seals against the chamber wall 46, the hydraulic liquid entering and exiting the chamber 22 is exclusively routed through the tube 42 of the bleed means 36 and the exhaust port 24. In other words, the bleed means 36 is disposed in the chamber 22 between the exhaust port 24 and the piston 28 so that all hydraulic liquid entering or exiting the chamber 22 must pass through the tube 42.

Referring to FIG. 1, it is shown that the tubular side 32 of the piston 28 and the tube 42 of the bleed means 36 are adapted for telescopic relative movement during operation. As the piston 28 moves toward the compressed position during operation, the tubular side 32 slides axially about the tube 42, and thus the hydraulic liquid disposed about the tube 42 is forced to flow in a direction first into the cavity 30 of the piston 28, i.e., away from the exhaust port 24, and then into the first opening 38, i.e., then toward the exhaust port 24. It will be observed that as the piston 28 approaches the compressed position, this fluid flow exiting the chamber 22 will sweep across the top spaced surface 34 to carry with it the trapped gas inclusions. Therefore, the bleed means 36 controls the movement of the hydraulic liquid exiting the chambers 22 to create a flow in a direction across the spaced top surface 34 to sweep the trapped gas inclusions away with the exhausting hydraulic liquid movement out of the exhaust port 24.

Biasing means 54 is disposed in each of the chambers 22 of the cylinder means 18 for urging each piston 28 out of its associated chamber 22. The biasing means 54 includes a helical wound compression spring 54 disposed about and supported by the tube 42 of the bleed means 36. The spring 54 extends from the flange 44 of the bleed means 36 to the top spaced surface 34 of the piston 28. As the piston 28 and the tube 42 of the bleed means 36 are adapted for telescopic relative movement during operation, the spring 54 along with the tube 42, is received into the cavity 30 of the piston 28 when the piston 28 is moved into the compressed position, as shown in FIG. 1. Therefore, adequate clearance is provided between the cylindrical side 32 of the cavity 30 and the outside of the tube 42 for the spring 54.

As shown in FIG. 1, the top spaced surface 34 of the piston 28 includes an annular peripheral groove 56 for receiving a top portion of the compression spring 54. In this manner, the spring 54 has one end disposed in the groove 56 and the other end disposed about the tube 42 and abutting the flange 44. As shown in FIG. 1, each piston 28 includes an exterior end 58 opposite the top spaced surface 34. The compression spring 54 urges the piston 28 out of its chamber 22 and against a swash plate cam means, generally indicated at 60. The swash plate cam means 60 engages the exterior end 58 of the piston 28 for controlling the length of stroke of the piston 28 per revolution of the rotor means 20, as will be described subsequently.

The swash plate cam means 60 is disposed about an input shaft 62 which extends centrally and axially from the rotor means 20. The input shaft 62 is rotatably supported by the housing 12 for rotation with the rotor means 20 about the rotor means axis. Typically, the input shaft 62 is connected to the steering wheel of a marine craft. An operator of the marine craft actuates the pump assembly 10 by rotating the steering wheel connected to the input shaft 62 which, in turn, rotates the rotor means 20 in the housing 12. Each of the pistons 28 are urged out of their associated chambers 22 by the springs 54 and against the swash plate cam means 60 so that with each revolution of the rotor means 20, the pistons are cycled through one full suction and discharge stroke.

The swash plate cam means 60 includes a camming surface 64 contiguous with the exterior end 58 of each piston 28 and disposed in a plane extending obliquely of the rotor means axis. The camming surface 64 has a high point 66 and a low point 68, which low point 68 is disposed 180° about the rotor means axis from the high point 66. The axial distance between the high point 66 and the low point 68 defines the length of stroke of the pistons 28. The swash plate cam means 60 also includes a bearing assembly, generally indicated at 70, which is disposed about the rotor means axis and includes two parallel annular plates 72 having roller bearings disposed therebetween. One of the annular plates 72, adjacent the rotor means 20, presents the camming surface 64.

Figure 2:
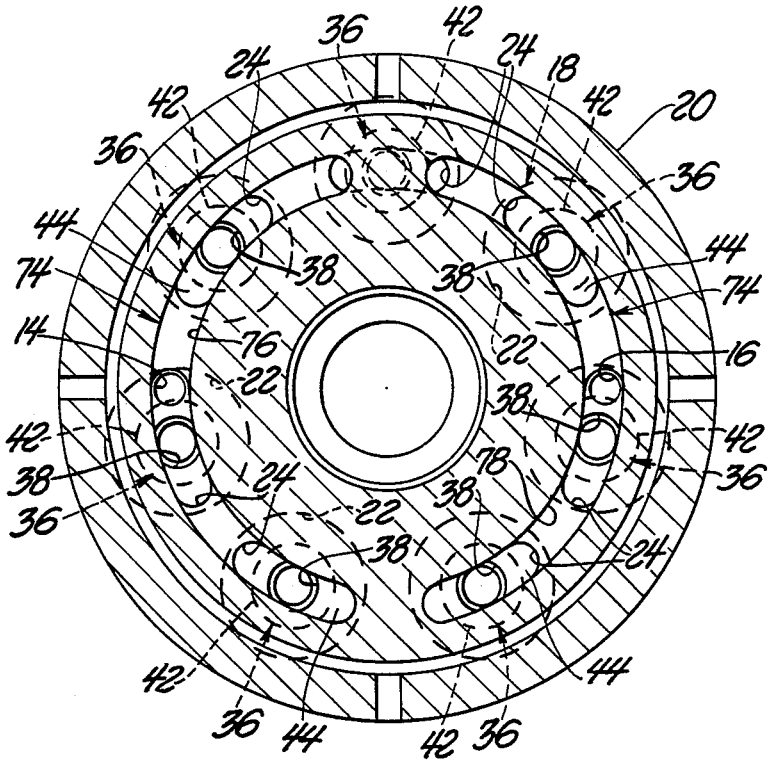
FIG. 2 is cross-sectional view taken along lines 2—2 of FIG. 1.

The housing 12 includes stationary interchange means, generally indicated at 74 in FIGS. 1 and 2, in fluid communication with the exhaust port 24 for directing fluid flow between the cylinder means 18 and the conduit system, via the first 14 and second 16 taps. As shown in FIG. 2, the interchange means 74 includes a first 76 and second 78 flow channel disposed in a plane perpendicular to the rotor means axis and extending arcuately about the rotor means axis. The first 76 and second 78 channels are symmetrical on either side of a plane extending through the rotor means axis and both the high point 66 and low point 68 of the camming surface 64. The first 76 and second 78 channels are adapted for intermittently communicating hydraulic fluid with each of the exhaust ports 24. The first tap 14 is disposed between the first channel 76 and the conduit system. Similarly, the second tap 16 is disposed between the second channel 78 and the conduit system. When the hydraulic liquid is drawn into the cylinder means 18 via the first tap 14 and first channel 76, the second channel 78 and second tap 16 convey the discharge of hydraulic liquid back into the conduit system. Alternatively, when, because of an oppositely rotated rotor means 20, the hydraulic liquid is drawn into the cylinder means 18 via the second tap 16 and the second channel 78, the first tap 14 and first channel 76 convey the discharge of hydraulic liquid back into the conduit system.

As best shown in FIG. 2, the exhaust ports 24 each include a kidney-shaped passage having an arcuate curvature centered at the rotor means axis and disposed in the rotor means 20 between the chambers 22 and the first 76 and second 78 channels of the housing 12. The shape of the exhaust port 24 conforms to the arcuate curvature of the first 76 and second 78 channels to provide good fluid transfer therebetween.

The operation of the subject hydraulic pumping assembly 10 as shown in FIG. 1 will be addressed presently. As referenced above, the input shaft 62 is connected to a marine craft steering wheel. When the operator of the marine craft desires to alter the direction of travel, the steering wheel is rotated in the desired direction, thus rotating the input shaft 62 and attached rotor means 20. With this, the pistons 28 in their associated chamber 22 are urged to trace the angled path on the camming surface 64.

Assuming for example that the rotor means is rotated in a clockwise direction as viewed in FIG. 2, the first channel 76 functions to discharge liquid from the cylinder means 18 and the second channel 78 functions to intake liquid from the conduit system, provided that the high point 66 of the camming surface 64 is in the twelve o'clock position and the low point 68 is in the six o'clock position. As the rotor means 20 is rotated clockwise under these conditions and assumptions, the three pistons 28 having associated exhaust ports 24 in communication with the first channel 76 are presently moving toward the compressed position. The one piston 28 which is in the twelve o'clock position, whose associated exhaust port 24 is straddling the first 76 and second 78 channels, is in the fully compressed position. The remaining three pistons 28 whose associated exhaust ports 24 are in communication with the second channel 78 are presently moving away from the compressed position to intake hydraulic liquid from the conduit system. Thus, with one complete revolution of the rotor means 20, each piston 28 completes one intake and exhaust cycle and in this manner the hydraulic pump assembly 10 of the subject invention moves the hydraulic liquid through the conduit system to actuate the steering cylinder connected to the outboard motor or rudder.

It will be appreciated that when the rotor means 20 is rotate in the counterclockwise direction, as viewed from FIG. 2, the three pistons 28 communicating with the second channel 78 discharge hydraulic liquid, whereas the three pistons 28 communicating with the first channel 76 function to intake the hydraulic liquid. In this manner, the hydraulic pump assembly 10 of the subject invention is fully reversible and can move the hydraulic liquid in either direction through the conduit system to steer the marine craft to either the right or the left.

ALTERNATIVE EMBODIMENT OF FIGS. 4–6

Figure 4:
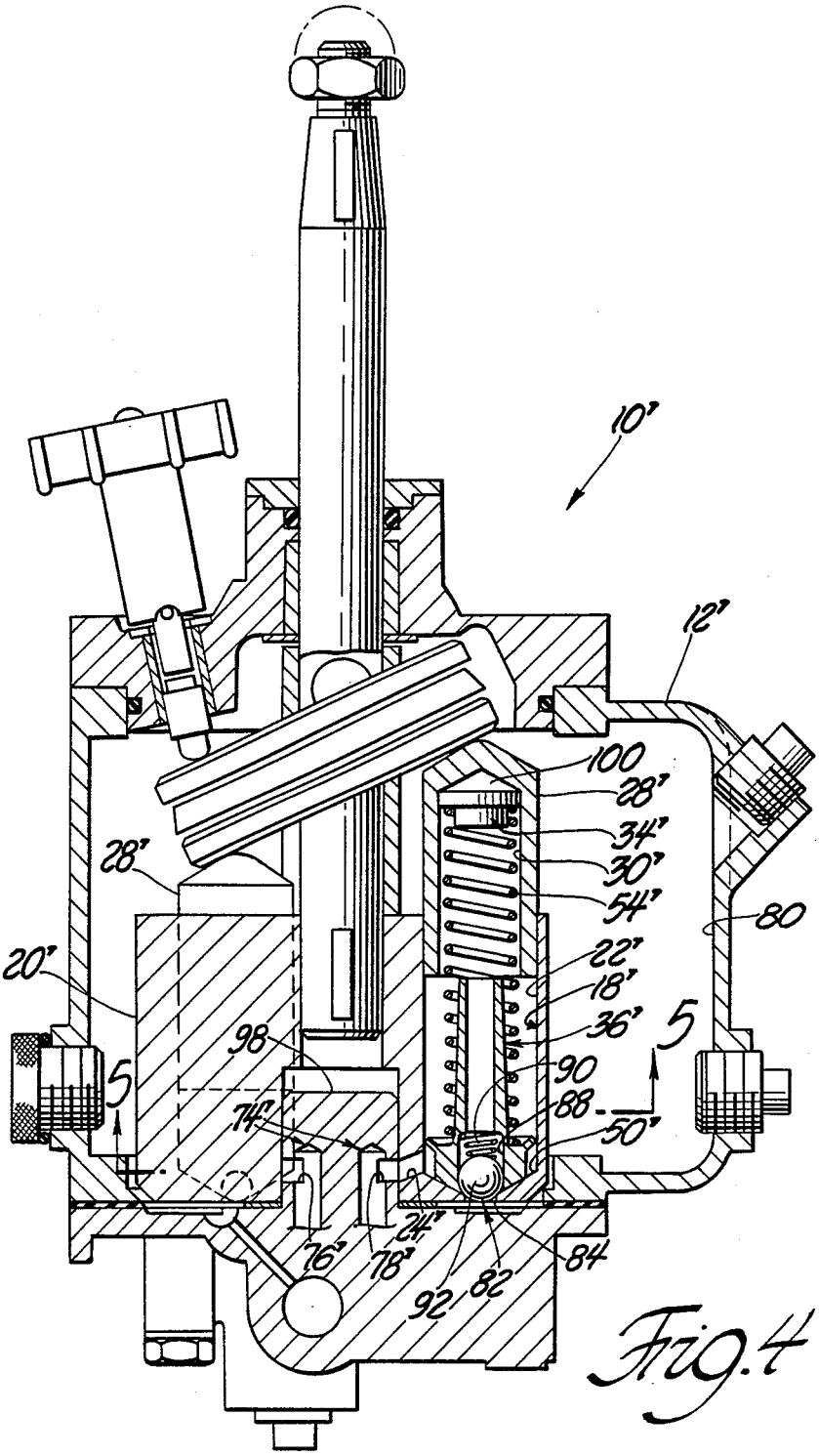
FIG. 4 is a side view of an alternative embodiment of the subject invention shown in cross section.
Figure 5:
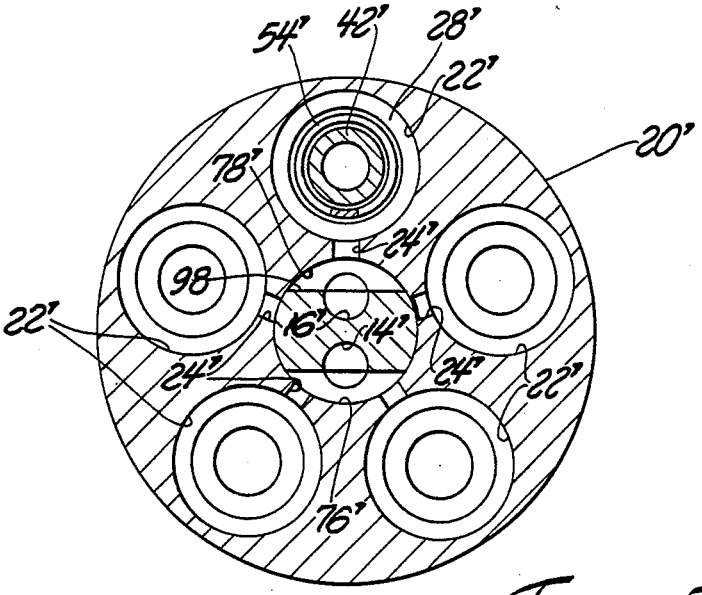
FIG. 5 is a cross-sectional view taken along lines 5—5 of FIG. 4.
Figure 6:
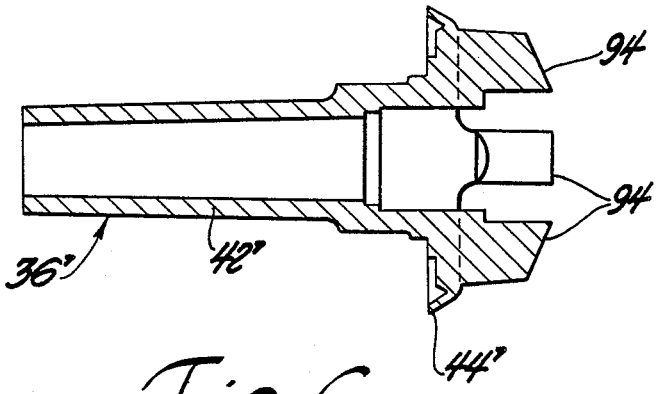
FIG. 6 is an enlarged cross-sectional view of the bleed means of FIGS. 4 and 5.

For convenience, the elements of FIGS. 4–6 corresponding in function to elements described in FIGS. 1–3 will be referenced with the like numbers and designated with a prime notation. Referring now to FIGS. 4–6, a spigot type hydraulic pumping assembly is generally shown at 10'. The housing 12', of the spigot pump assembly 10', as shown in FIG. 4, includes an internal reserve liquid tank 80, or reservoir, surrounding the cylinder means 18'. The housing 12' is adapted to contain a substantial quantity of liquid about the rotor means 20' for reasons to be address presently. Reserve intake means, generally indicated at 82 in FIG. 4, are provided for supplying hydraulic liquid from the reserve liquid tank 80 to each of the five chambers 22' when the supply volume of liquid to the cylinder means 18' from the conduit system is less than the required volume. In other words, due to the practical realities experienced during normal operation, the reserve intake means 82 allows each chamber 22' to withdraw additional liquid from the reserve liquid tank 80 in the event, during the intake stroke, the quantity of hydraulic liquid sucked in from the conduit system is less than the amount required.

The reserve intake means 82 includes a reverse intake passage 84 disposed between the reserve tank 80 of the housing 12' and each chamber 22' adjacent the lower head surface 50'. More specifically, the reserve intake means 82 includes a central recess 88 in the bleed means 36' adjacent the reserve intake passage 84. A biasing member 90, in the form of a compression spring, is disposed in the recess 88 along with a spherical seal member 92. The seal member 92 functions as a check valve for sealing the reserve intake passage 84 to allow additional liquid from the reserve liquid tank 80 to flow into the chamber 22' while preventing liquid from the chamber 22' to exit into the reserve liquid tank 80.

As perhaps best shown in FIG. 6, the flange 44' of the bleed means 36' includes a plurality of fingers 94 which extend axially from the flange 44'. The spaces between the fingers 94 function as flow apertures for communicating hydraulic liquid between the chamber 22' and the exhaust port 24'.

A stationary spigot 98 is disposed radially inwardly of each of the chambers 22' and centered along the rotor means axis, as shown in FIG. 4, for directing the fluid flow between the exhaust port 24' and the conduit system. The spigot 98 is fixed relative to the housing 12' as it functions to direct the hydraulic liquid between the conduit system and each of the chambers 22'. The spigot 98 also includes the first 76' and second 78' channels in a manner well known in the art, as shown in FIG. 5.

As shown in FIG. 4, a plug-like insert 100 is disposed in the cavity 30' of the each of the pistons 28' and facilitates fabrication of the cavity 30'. The insert 100 has an upper surface which comprises the top spaced surface 34' of the piston 28. Therefore, during operation, gas inclusions entering the chamber 22' will rise to the highest point adjacent the top spaced surface 34' to await expulsion as facilitated by the bleed means 36'.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A piston pump assembly (10) of the type for moving a liquid through a conduit system comprising: a housing (12); cylinder means (18) disposed in said housing (12) for receiving a volume of liquid from and expelling the same volume of liquid back into the conduit system, said cylinder means (18) including at least one liquid exhaust port (24); piston means (26) slideably disposed in said cylinder means (18) toward and away from a compressed position adjacent said exhaust port (24) for urging liquid through said exhaust port (24), said piston means (26) including a surface (34) in continuous contact with the liquid and spaced remotely of said exhaust portion (24) when said piston means (26) is adjacent said compressed position; said assembly (10) characterized by including bleed means (36) disposed in said cylinder means (18) having a first opening (38) in communication with said exhaust port (24) and a second opening (40) closely spaced from said spaced surface (34) when said piston means (26) is adjacent said compressed position for exclusively expelling the liquid from said cylinder means (18) through both of said first (38) and second (40) openings as said piston means (26) moves toward said compressed position to force gas inclusions trapped in said cylinder means (18) adjacent said spaced surface (34) into said bleed means (36) and out of said cylinder means (18).

2. A piston pump assembly (10) of the type for moving a liquid through a conduit system comprising: a housing (12); cylinder means (18) disposed in said housing (12) for receiving a volume of liquid from and expelling the same volume of liquid back into the conduit system, said cylinder means (18) including at least one liquid exhaust port (24); piston means (26) slideably disposed in said cylinder means (18) toward and away from a compressed position adjacent said exhaust port (24) for urging liquid through said exhaust port (24), said piston means (26) including a surface (34) in continuous contact with the liquid and spaced remotely of said exhaust port (24) when said piston means (26) is adjacent said compressed position; said assembly 910) characterized by including bleed means (36) disposed in said cylinder means (18) and defining an exterior surface presented toward said cylinder means (18) and an interior surface disposed opposite said exterior surface for controlling the exiting movement of the liquid disposed adjacent said exterior surface to flow in a direction first away from said exhaust port (24) and then across said spaced surface (34) and then toward said exhaust port (24) to sweep gas inclusions trapped adjacent said spaced surface (34) with the exhaust liquid movement and out of said exhaust port (24).

3. An assembly (10) as set forth in claim 2 further characterized by said bleed means (36) having a first opening (38) in communication with said exhaust port (24) and a second opening (40) closely spaced from said spaced surface (34) when said piston means (26) is adjacent said compressed position for expelling the liquid from said cylinder means (18) as said piston means (26) moves toward said compressed position.

4. An assembly (10) as set forth in either of claims 1 or 3 further characterized by said bleed means (36) including an elongated tube (42) extending between said first (38) and second (40) openings straight from said exhaust port (24) to said spaced surface (34).

5. An assembly as set forth in claim 4 further characterized by including a flange (44) extending outwardly from said tube (42) adjacent said first opening (38) for sealing about said exhaust port (24) to exclusively route fluid flow exiting said cylinder means through said tube (42) of said bleed means (36).

6. An assembly (10) as set forth in claim 5 further characterized by including rotor means (20) supported in said housing (12) for rotation about an axis, and said cylinder means (18) including at least one piston chamber (22) disposed in said rotor means (20) having a central longitudinal axis for slideably receiving said piston means (26), said longitudinal axis of said chamber (22) and said rotor means axis extending in a spaced parallel relationship.

7. An assembly (10) as set forth in claim 5 further characterized by including biasing means (54) for urging said piston means (26) out of said chamber (22).

8. An assembly (10) as set forth in claim 7 further characterized by said piston means (26) including a cylindrical piston (28) having a generally U-shaped cross-section defining a central tubular cavity (30) in continuous contact with the liquid bounded by a tubular side (32) and a circular top (34), said top (34) of said cavity (30) including said spaced surface (34) of said piston means (26).

9. An assembly (10) as set forth in claim 8 wherein said piston (28) includes an exterior end (58) opposite said top spaced surface (34), further characterized by said assembly (10) including cam means (60) engaging said exterior end (58) of said piston (28) for controlling the length of stroke of said piston (28) per a predetermined number of revolutions of said rotor means (20).

10. An assembly 10 as set forth in claim 9 further characterized by said elongated tube (42) of said bleed means (36) having an axis coincidental with said longitudinal axes of said chamber (22) and said cavity (30), and said annular flange (44) extending radially outwardly of said tube (42).

11. An assembly (10) as set forth in claim 10 wherein said chamber (22) is bounded by a cylindrical inner wall (46) disposed in said rotor means (20) extending from a top opening (48) to a lower head surface (50), further characterized by said flange (44) of said bleed means (36) having an outer edge (52) in continuous peripheral sealing engagement with said chamber wall (46) adjacent said exhaust port (24) to exclusively route fluid exiting said chamber (22) through said tube (42) of said bleed means (36) to said exhaust port (24).

12. An assembly (10) as set forth in claim 11 further characterized by said tubular side (32) of said piston (28) and said tube (42) of said bleed means (36) being adapted for telescopic relative movement whereby said tube (42) and said biasing means (54) are received into said cavity (30) of said piston (28) when adjacent said compressed position.

13. An assembly (10) as set forth in claim 12 further characterized by said biasing means including a helical wound compression spring disposed about said tube (42) of said bleed means (36) and extending between said flange (44) of said bleed means (36) and said to spaced surface (34) of said piston (28).

14. An assembly (10) as set forth in claim 13 further characterized by said top spaced surface (34) of said piston (28) including an annular groove (56) for receiving a portion of said compression spring (54).

15. An assembly (10) as set forth in claim 13 further characterized by said assembly (10) including an input shaft (62) extending centrally and axially from said rotor means (20), said input shaft (62) rotatably supported by said housing (12) for rotation with said rotor means (20) about said rotor means axis.

16. An assembly (10) as set forth in claim 15 further characterized by said cam means (60) including a camming surface (64) contiguous with said exterior end (58) of said piston (28) and disposed in a plane extending obliquely of said rotor means axis having a high point (66) and a low point (68) disposed 180 degrees about said rotor means axis from said high point (66), the axial distance between said high point (66) and said low point (68) defining the length of stroke of said piston (28).

17. An assembly (10) as set forth in claim 16 further characterized by said cam means (60) including a bearing assembly (70) disposed about said rotor means axis and including parallel annular plates (72) with roller bearings disposed therebetween, one of said plates (72) presenting said camming surface (64).

18. An assembly (10) as set forth in claim 17 further characterized by said housing (12) including stationary interchange means (74) in fluid communication with said exhaust port (24) for directing fluid flow between said cylinder means (18) and the conduit system.

19. An assembly (10) as set forth in claim 18 further characterized by said interchange means (74) including first (76) and second (78) channels disposed in a plane perpendicular of said rotor means axis and extending arcuately about said rotor means axis and symmetrical on either side of a plane extending through said rotor means axis and said high point (66) and said low point (68) of said camming surface (64), said first (76) and second (78) channels adapted for intermittent communication with said exhaust port (24).

20. An assembly (10) as set forth in claim 19 further characterized by said interchange means (74) including a first tap (14) disposed between said first channel (76) and the conduit system and a second tap (16) disposed between said second channel (78) and the conduit system.

21. An assembly (10) as set forth in claim 20 further characterized by said exhaust port (24) having a kidney shape with an arcuate curvature centered at said rotor means axis and disposed in said rotor means (20) between said chamber (22) and said housing (12).

22. An assembly (10') as set forth in claim 20 further characterized by including reserve intake means (82) disposed in said chamber (22') for supplying liquid to said chamber (22') when the supply volume of liquid to said cylinder means (18') from said first (76') and second (78') channels is less than the required volume.

23. An assembly (10') as set forth in claim 22 further characterized by said housing (12') including an internal reserve liquid tank (80) surrounding said cylinder means (18').

24. An assembly (10') as set forth in claim 23 further characterized by said reserve intake means (82) including a reserve intake passage (84) disposed between said reserve tank (80) of said housing (12') and said chamber (22') adjacent said reserve intake means (82).

25. An assembly (10') as set forth in claim 24 further characterized by said reserve intake means (82) including a reserve valve body (86) disposed between said reserve intake passage (84) and said flange (44') of said bleed means (36') and having a central recess (88) adjacent said reserve intake passage (84), a biasing member (90) disposed in said recess (88), and a seal member (92) disposed in said recess (88) between said biasing member (90) and said reserve intake passage (84).

26. An assembly (10') as set forth in claim 25 further characterized by said flange (44') of said bleed means (36') including an annular ledge (94) extending axially therefrom to said reserve valve body (86), said ledge (94) including at least one flow aperture (96) disposed radially therethrough.

27. An assembly (10') as set forth in claim 26 further characterized by including a stationary spigot (98) disposed radially inwardly of said chamber (22') and centered along said rotor means axis for directing the fluid flow between said exhaust port (24') and the conduit system.

28. An assembly (10') as set forth in claim 27 further characterized by said piston means (26') including an insert (100) disposed in said cavity (30') having an upper surface comprising said top spaced surface (34).

* * * * *